US007823580B2

(12) United States Patent
Sinur et al.

(10) Patent No.: US 7,823,580 B2
(45) Date of Patent: Nov. 2, 2010

(54) RANGE HOOD APPARATUS AND METHOD

(75) Inventors: Richard R. Sinur, Grafton, WI (US); Brian R. Wellnitz, Grafton, WI (US); Paul E. Hsu, Powell, OH (US); Jay F. Perkins, Pickerington, OH (US)

(73) Assignee: Broan-Nutone LLC, Hartford, WI (US)

( * ) Notice: Subject to any disclaimer, the term of this patent is extended or adjusted under 35 U.S.C. 154(b) by 820 days.

(21) Appl. No.: 11/125,404

(22) Filed: May 9, 2005

(65) Prior Publication Data

US 2006/0250799 A1 Nov. 9, 2006

(51) Int. Cl.
*F24C 15/20* (2006.01)
*F23J 11/00* (2006.01)

(52) U.S. Cl. ..... 126/299 R; 126/299 D; 362/290; 362/342; 362/354; 362/812; 362/286

(58) Field of Classification Search ..... 126/299 R, 126/290, 299 D; 362/290, 342, 354, 812, 362/286

See application file for complete search history.

(56) References Cited

U.S. PATENT DOCUMENTS 2,341,245 A * 2/1944 Sonntag ..... 126/299 D
3,359,885 A * 12/1967 Fachling ..... 126/299 D
3,752,056 A * 8/1973 Chamberlin et al. ..... 454/59
3,936,107 A * 2/1976 Gourdeau et al. ..... 312/329
4,088,123 A 5/1978 Bowen, Jr. et al.
4,137,038 A 1/1979 Vorobeichikov et al.
4,614,177 A * 9/1986 Buckley et al. ..... 126/299 R
4,622,622 A * 11/1986 Baba ..... 362/476
D315,204 S 3/1991 Fleming et al.
5,027,790 A 7/1991 Chern
5,062,410 A * 11/1991 Sarnosky et al. ..... 126/299 D
5,363,837 A 11/1994 Jang (Continued)

FOREIGN PATENT DOCUMENTS

DE 3204068 A1 * 6/1982

(Continued)

OTHER PUBLICATIONS

Broan-Nutone, Photographs and descriptions of Broan-NuTone Range Hoods from www.broan.com, webpage visited May 18, 2007.

*Primary Examiner*—Steven B McAllister
*Assistant Examiner*—Nikhil Mashruwala
(74) *Attorney, Agent, or Firm*—Greenberg Traurig, LLP

(57) ABSTRACT

Method and apparatus for a range hood. The apparatus can include a housing and a lighting and control unit moveably coupled to the housing. The lighting and control unit can include a user interface and one or more lights. The lighting and control unit can be coupled to a motor that can move a first face of the lighting and control unit outward during use and can move the first face of the lighting and control unit inward when not in use. Some embodiments of the invention provide a fan mounted within the housing and a louver assembly coupled to the housing. The louver assembly can include one or more rotating louvers. In some embodiments, the louver assembly can be rotated downward to access at least one of a filter, a motor, and user interface electronics.

13 Claims, 7 Drawing Sheets

U.S. PATENT DOCUMENTS

| | | | | |
|---|---|---|---|---|
| 5,385,031 | A * | 1/1995 | Kizawa et al. | 62/186 |
| D375,351 | S | 11/1996 | Conforti | |
| D379,501 | S | 5/1997 | Airosa et al. | |
| D380,823 | S | 7/1997 | LaZar | |
| D439,649 | S | 3/2001 | Wyler et al. | |
| D439,650 | S | 3/2001 | Wellnitz et al. | |
| 6,291,809 | B1 * | 9/2001 | Ha | 219/757 |
| D450,379 | S | 11/2001 | Strand et al. | |
| D450,829 | S | 11/2001 | Bothe et al. | |
| D460,547 | S | 7/2002 | Li | |
| 6,470,680 | B1 * | 10/2002 | Janeke | 60/597 |
| 6,470,880 | B1 * | 10/2002 | Chang | 126/299 D |
| 6,499,482 | B1 * | 12/2002 | Hung | 126/299 R |
| D473,297 | S | 4/2003 | Bothe et al. | |
| D482,769 | S | 11/2003 | Bothe et al. | |
| 6,715,484 | B2 * | 4/2004 | Khosropour et al. | 126/299 R |
| D489,805 | S | 5/2004 | Vetter | |
| 6,877,506 | B2 * | 4/2005 | Shekarri | 126/299 R |
| D521,622 | S | 5/2006 | Bothe et al. | |
| D535,009 | S | 1/2007 | Sinur et al. | |
| 2004/0069770 | A1 * | 4/2004 | Cary et al. | 219/522 |
| 2005/0092745 | A1 * | 5/2005 | Yim et al. | 219/757 |

FOREIGN PATENT DOCUMENTS

| | | | |
|---|---|---|---|
| DE | 3204068 | A1 * | 8/1983 |
| DE | 3424330 | A1 | 1/1986 |
| EP | 337935 | * | 8/1989 |
| EP | 1239228 | A2 * | 9/2002 |
| EP | 1278017 | A1 * | 1/2003 |
| FR | 2851326 | A3 * | 1/2004 |
| FR | 0022851326 | A3 * | 8/2004 |

* cited by examiner

RANGE HOOD APPARATUS AND METHOD

BACKGROUND

Conventional range hoods are designed to provide light to a range top and to ventilate air (or cooking effluent) from the cooking area above the range top. Conventional range hoods generally have control panels rigidly mounted to a front face. Also, conventional range hoods generally can not be customized to coordinate with their environment. In addition, conventional range hoods generally include louver assemblies that are rigidly mounted, making the filters difficult to access for cleaning and maintenance.

SUMMARY

In one embodiment, the invention includes a range hood for providing light to a range top. The range hood can include a housing and a lighting and control unit moveably coupled to the housing. The lighting and control unit can include a user interface and at least one light. The lighting and control unit can be coupled to a motor that can move a first face of the lighting and control unit outward during use and can move the first face of the lighting and control unit inward when not in use.

Some embodiments of the invention provide a range hood for removing cooking effluent from an area above a range top. The range hood can include a housing, a fan mounted within the housing, and a louver assembly coupled to the housing. The louver assembly can include one or more louvers. The louvers can be coupled to a motor. In one embodiment, the motor can rotate the louvers open at an angle that depends on a speed of the fan. In some embodiments, the louver assembly can be rotated downward to access at least one of a filter, a motor, and user interface electronics.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
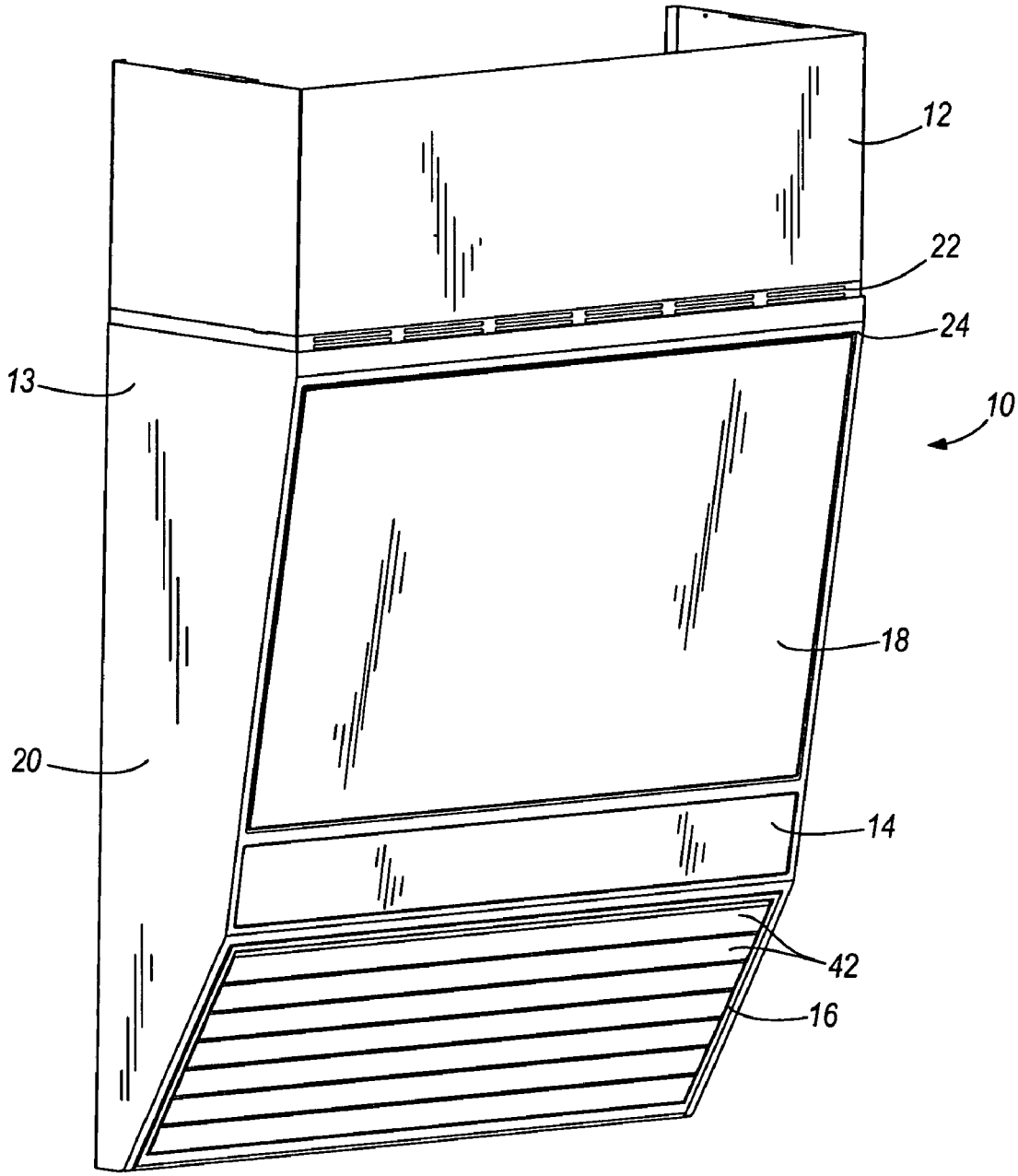
FIG. 1 is a perspective view of a range hood having a moveable control panel in a closed position according to one embodiment of the invention.
Figure 2:
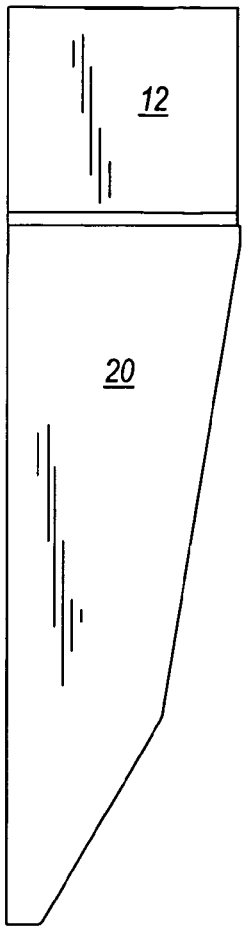
FIG. 2 is side view of the range hood of FIG. 1.
Figure 3:
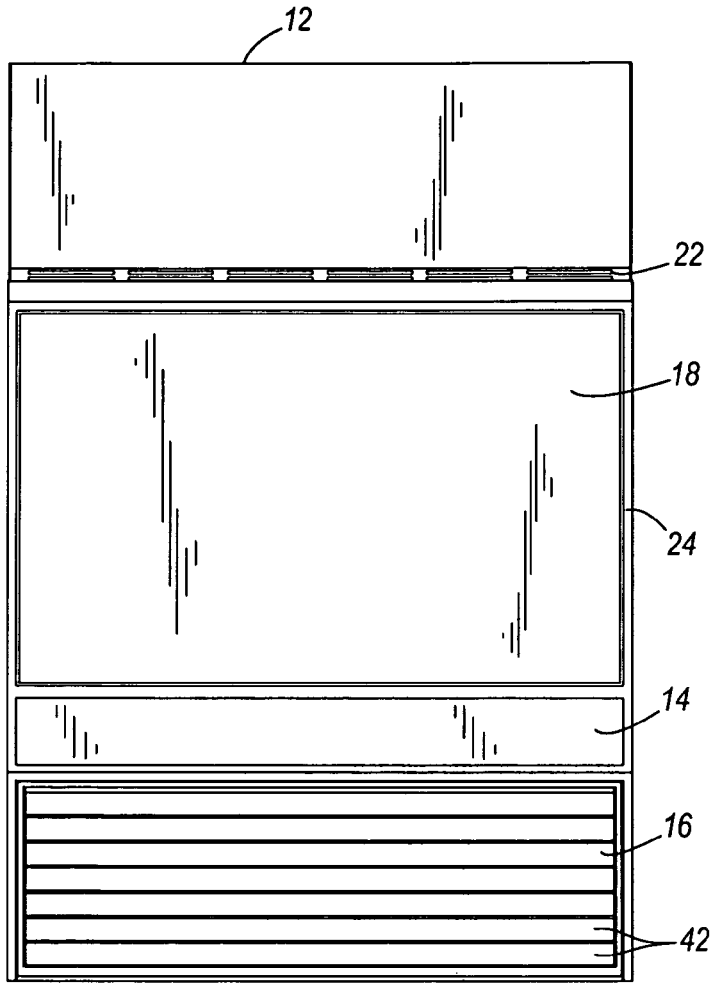
FIG. 3 is a front view of the range hood of FIG. 1.
Figure 4:
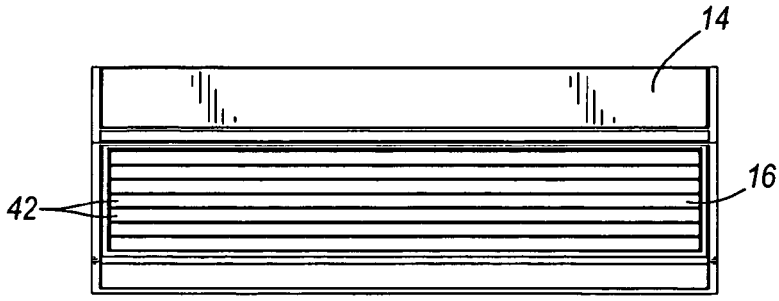
FIG. 4 is a bottom view of the range hood of FIG. 1.
Figure 5:
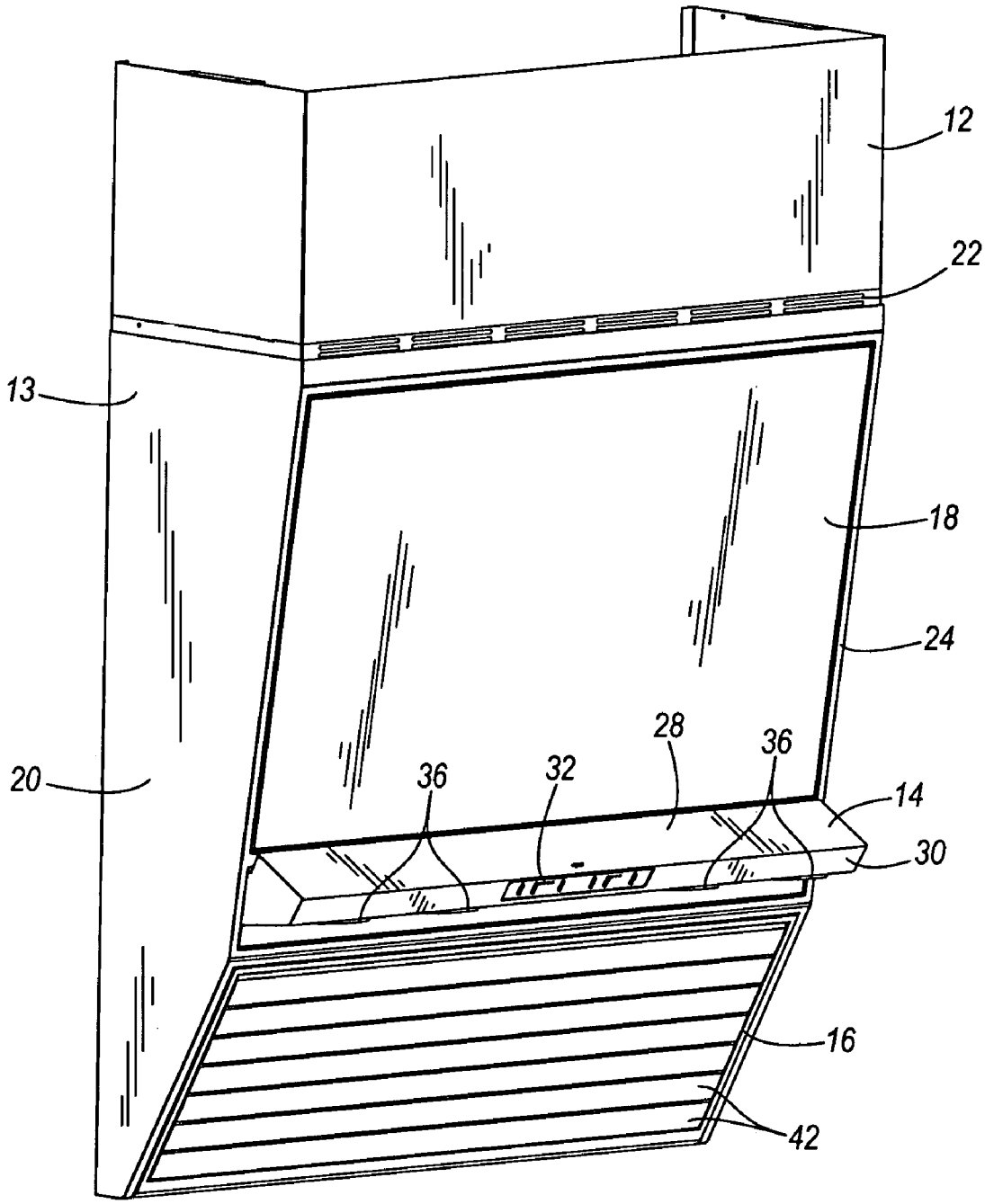
FIG. 5 is a perspective view of the range hood of FIG. 1 with the moveable panel in an open position.
Figure 6:
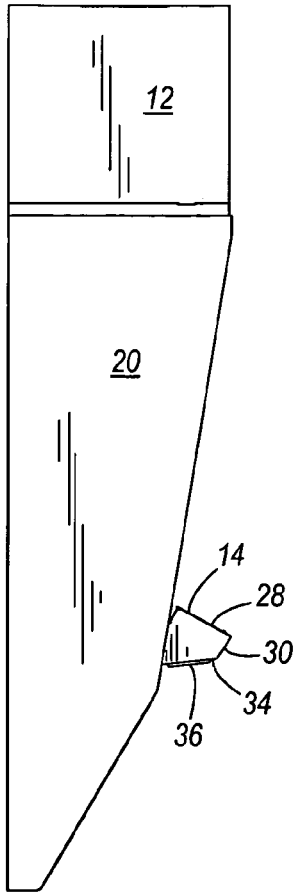
FIG. 6 is a side view of the range hood of FIG. 5.
Figure 7:
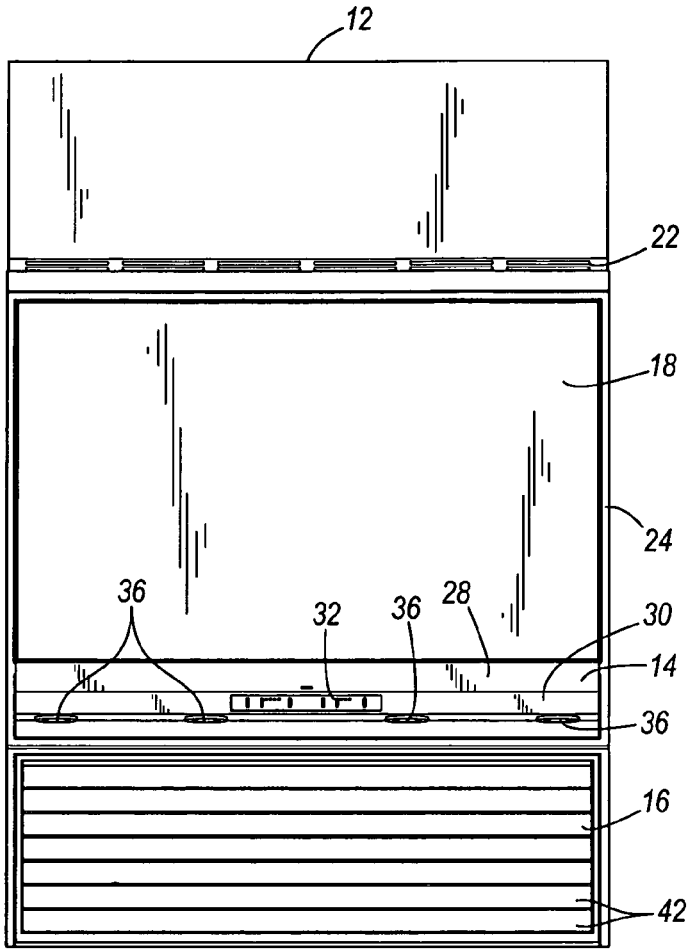
FIG. 7 is a front view of the range hood of FIG. 5.

FIG. 1 illustrates a range hood 10 according to one embodiment of the invention. The range hood 10 can include a flue 12, a housing 13, a lighting and control unit 14, a louver assembly 16, a front panel 18, and a palette 24.

Figure 10:
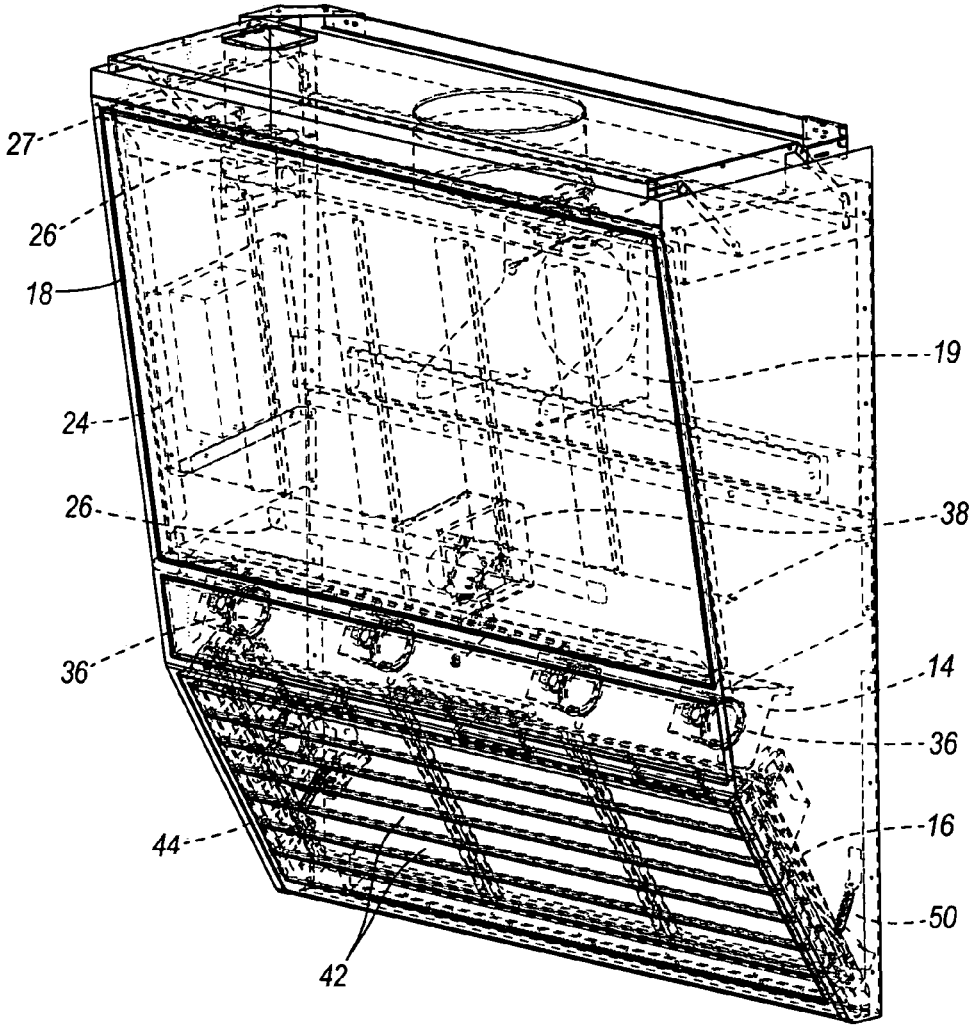
FIG. 10 is a perspective frame assembly view of the range hood of FIG. 1.

The flue 12 can be coupled to the housing 13 in any suitable manner. In some embodiments, the flue 12 includes one front panel and two side panels. The flue 12 can be coupled to a wall, a ceiling, ducting, and/or recirculation components in any suitable manner. Additional ducting or recirculation components (as shown in FIG. 10) can be positioned within an interior portion of the flue 12. The flue 12 can be at least partially constructed of a decorative material, such as stainless steel, painted metal, copper, etc.

The housing 13 can hang on a wall surface. A rear panel of the housing 13 can be coupled to the wall in any suitable manner. A fan 19 (as shown in FIG. 10) can be positioned in an upper portion of the housing 13 above the louver assembly 16. The fan 19 can be mounted with one or more supports to the rear panel of the housing 13. The housing 13 can be coupled to the lighting and control unit 14, the louver assembly 16, and the palette 24. The housing 13 can include one or more sets of vents 22, such as several sets of vents 22 positioned across a front, top portion of the housing 13.

Figure 11:
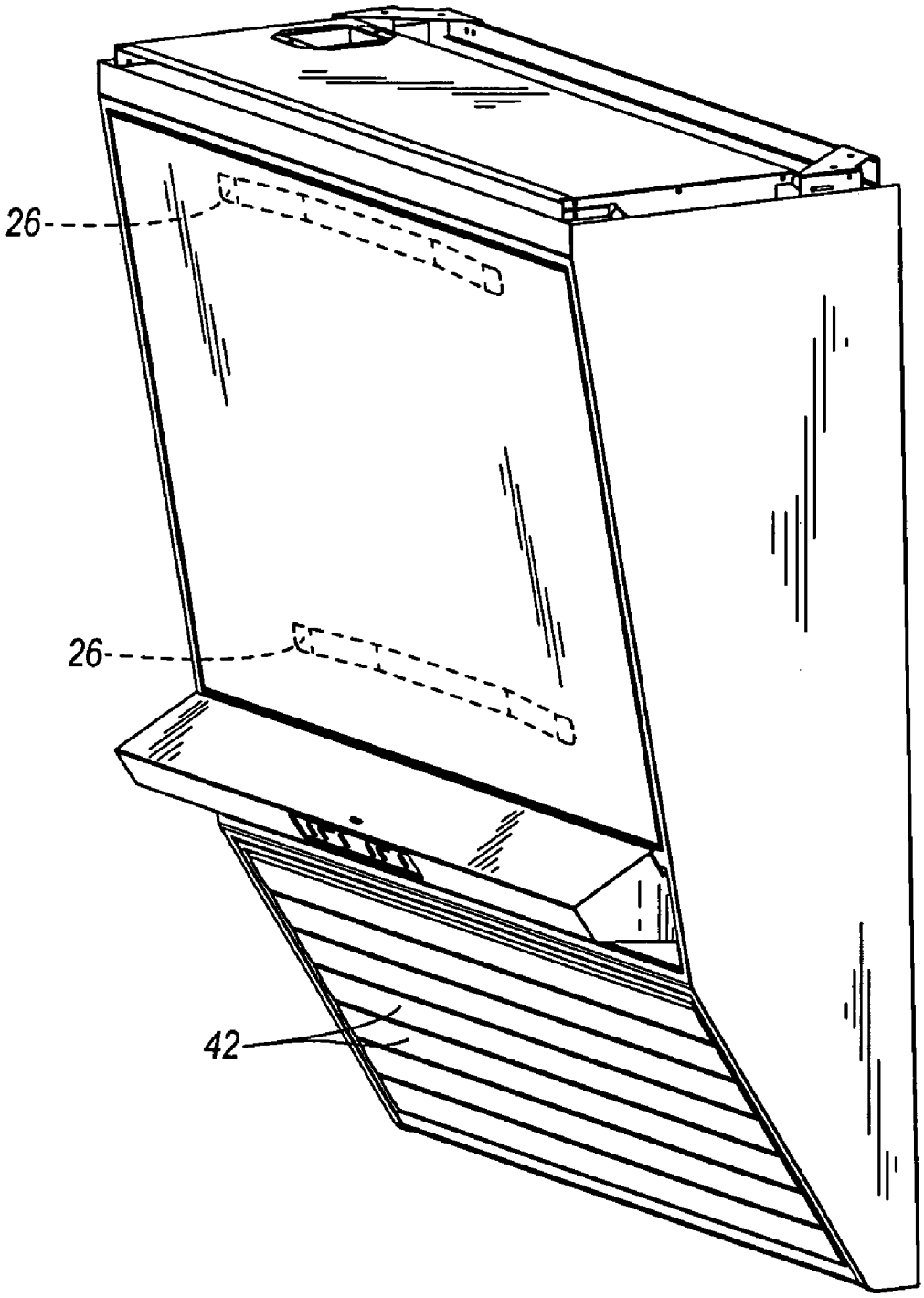
FIG. 11 is a perspective frame assembly view of a range hood according to another embodiment of the invention.

In some embodiments, the housing 13 can include a front panel 18 in the form of a recessed portion on a front side of the housing 13. The front panel 18 can receive the palette 24, such as a decorative panel constructed of ceramic tile, glass, stainless steel, copper, a solid surfacing material (e.g., Corian® manufactured by E. I. du Pont de Nemours and Company), etc. In some embodiments, the palette 24 can be attached to the front panel 18 with small tabs on the bottom of the palette 24 that engage with slots that can be located in a body portion of the front panel 18 and/or the housing 13. Once the bottom tabs are in place, the palette 24 can be rotated upward. As shown in FIG. 10, one or more latches 27 (e.g., a spring-loaded latch) can be positioned on a top portion of the front panel 18. The latch 27 can engage with slots on a top portion of the palette 24. When the palette 24 is rotated up completely, the latch 27 can engage the palette 24 and snap the palette 24 in place. The palette 24 can also be coupled to the front panel 18 with one or more leaf springs 26 (as shown in FIGS. 10 and 11) that can accommodate various thicknesses of materials. The leaf springs 26 can also apply outward pressure to keep the palette 24 from repeatedly contacting the front panel 18 and making noise. In some embodiments, the palette 26 can be removed by sliding a thin piece of material (e.g., a credit card) in between a top edge of the palette 26 and the front panel 18 to disengage the latch 27. The top portion of the palette 26 can then rotate freely and can be lifted from the bottom tabs and removed.

Figure 8:
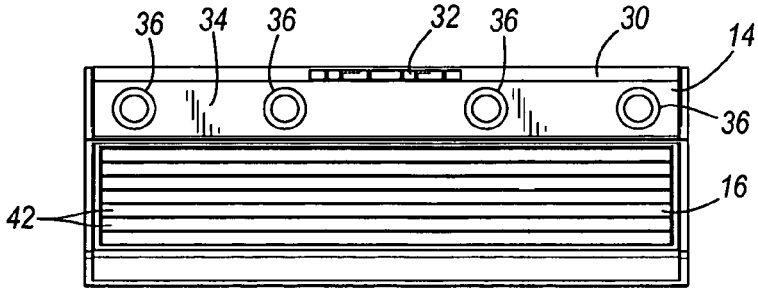
FIG. 8 is a bottom view of the range hood of FIG. 5.

The lighting and control unit 14 can include a first face 28 that can lie in substantially the same plane as the palette 24 and be substantially flush with edges of the housing 13 when the lighting and control unit 14 is in a closed position, as shown in FIGS. 1-4 and 10. As shown in FIGS. 5-9 and 11, the lighting and control unit 14 can be rotated upward to reveal a second face 30 with a user interface 32 and a third face 34 with one or more task lights 36 (as shown in FIG. 8). The task lights 36 can be recessed lights. The user interface 32 can include any one or more of the following: one or more controls, one or more indicator lights, one or more timers, a digital clock, etc. The controls can be used to control the fan and/or the task lights 36. In some embodiments, the first face 28, the second face 30, and the third face 34 can each have a rectangular shape. In one embodiment, as shown in FIG. 11, side edges of the second face 30 can be rounded and the third face 34 can be recessed within the rounded edges of the second face 30.

The lighting and control unit 14 can be rotatably coupled to the housing 13 in any suitable manner. In some embodiments, the lighting and control unit 14 coupled to a motor 38 positioned within the housing 13. The motor 38 can rotate the first face 28 of the lighting and control unit 14 outward when in the user interface 32 is in use and rotate the first face 28 inward when the user interface 32 is not in use. For example, a user can push a button or a portion of the first face 28 to open or close the motorized lighting and control unit 14. Alternatively or additionally, the lighting and control unit 14 can be biased by springs or the like to open or close when a button or a portion of the first face 28 is pushed.

Figure 9:
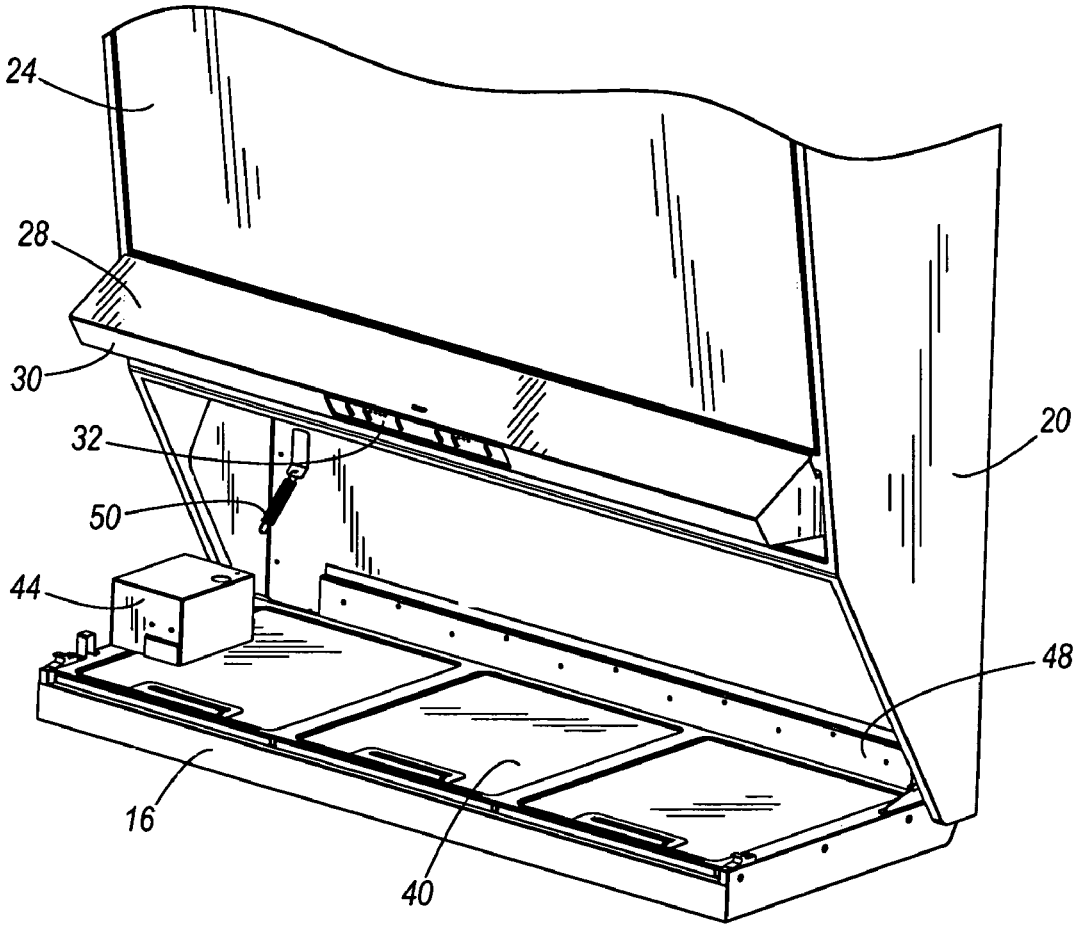
FIG. 9 is a perspective view of the range hood of FIG. 5 with a louver assembly in an open position.

The louver assembly 16 can include a filter 40 through which the fan 19 positioned within the housing 13 can draw the cooking effluent. The louver assembly 16 can include any suitable number and configuration of louvers 42. In some embodiments, the louvers 42 can be coupled to a motor 44 (as shown in FIG. 9). The motor 44 can be secured to an inside panel of the louver assembly 16. The motor 44 can be used to control the louvers 42 in order to open the louvers 42 and capture cooking effluent when the range hood is in use. The motor 44 can close the louvers 42 when the range hood in not in use. In some embodiments, the motor 44 can open the louvers 42 at various degrees depending on the speed of the fan 19 in order to provide a substantially constant velocity for the capture of cooking effluent.

In some embodiments, the entire louver assembly 16 or a portion of the louver assembly 16 can rotate downward in order to gain access to the filter 40, which can be cleaned or removed and replaced. The louver assembly 16 can also be rotated downward to service the electronics of the user interface 32 and/or to service the motors 38 and 44. The louver assembly 16 can include a release latch 46, as shown in FIG. 9, that can allow a user to quickly release the louver assembly 16 from the housing 13. The louver assembly 16 can be coupled to the housing 13 by a hinge 48, as shown in FIG. 9. The louver assembly 16 can include one or more springs 50 that can prevent the louver assembly 16 from falling open against the wall to which the housing 13 is mounted. In other embodiments, the louver assembly 16 can rotate upward to gain access to the filter 40 and the motors 38 and 44, and the louver assembly 16 can be held open by a suitable bracket.

Various features and advantages of the invention are set forth in the following claims.

The invention claimed is:

1. A range hood for providing light to a range top, the range hood comprising:

a housing positioned substantially over one of a heat source and a vapor source, the housing including a front panel positioned between an air inlet and a flue, and positioned along an air flow path;

a lighting and control unit including a user interface and at least one task light for illuminating the range top, the user interface including a control to operate one of the task light and a fan, the user interface and the at least one task light being moveably coupled to the housing, the lighting and control unit being coupled to a motor that moves a first face of the lighting and control unit outward during use and moves the first face of the lighting and control unit inward when not in use to conceal the user interface from view;

a palette coupled to the front panel, the palette being interchangeable, the palette being constructed of at least one of ceramic tile, glass, stainless steel, copper, and a solid surfacing material, and being positioned substantially parallel to a direction of air flow through the flue; and at least one resilient fastener coupling the palette to the front panel and limiting movement of the palette with respect to the front panel as air moves along the air flow path.

2. The range hood of claim 1 wherein the at least one resilient fastener includes at least one of a latch and a leaf spring.

3. The range hood of claim 1 wherein the lighting and control unit includes a second face and a third face, the user interface coupled to the second face, and the at least one task light coupled to the third face.

4. The range hood of claim 3 wherein at least one of the first face, the second face, and the third face is rectangular in shape.

5. The range hood of claim 3 wherein the second face includes rounded edges and the third face is recessed within the second face.

6. The range hood of claim 1 and further comprising a louver assembly coupled to the housing.

7. The range hood of claim 6 wherein the louver assembly rotates downward to access at least one of a filter and a motor.

8. The range hood of claim 6 wherein the louver assembly includes at least one louver, the at least one louver rotating open to capture cooking effluent.

9. The range hood of claim 8 wherein the at least one louver rotates open at an angle that depends on a speed of a fan.

10. The range hood of claim 8 wherein the at least one louver is motorized to open and close.

11. The range hood of claim 10 wherein a second louver motor is coupled to the louver assembly and the at least one louver.

12. The range hood of claim 1 wherein the at least one resilient fastener includes a leaf spring.

13. The range hood of claim 1 wherein the lighting and control unit is positioned below the palette, and wherein the lighting and control unit is rotatably coupled to the range hood for rotation with respect to the range hood.

* * * * *